US009963861B2

(12) United States Patent
Leon-Quintero et al.

(10) Patent No.: US 9,963,861 B2
(45) Date of Patent: May 8, 2018

(54) VACUUM BREAKER

(71) Applicant: Zurn Industries, LLC, Milwaukee, WI (US)

(72) Inventors: Cesar J. Leon-Quintero, Chapel Hill, NC (US); Brandon Ancona, Sanford, NC (US); Michael A. Funari, Apex, NC (US)

(73) Assignee: Zurn Industries, LLC, Milwaukee, WI (US)

( * ) Notice: Subject to any disclaimer, the term of this patent is extended or adjusted under 35 U.S.C. 154(b) by 0 days. days.

(21) Appl. No.: 15/356,123

(22) Filed: Nov. 18, 2016

(65) Prior Publication Data

US 2017/0145672 A1 May 25, 2017

Related U.S. Application Data

(60) Provisional application No. 62/258,117, filed on Nov. 20, 2015.

(51) Int. Cl.
*E03C 1/10* (2006.01)
*E03D 3/00* (2006.01)

(52) U.S. Cl.
CPC ..... *E03C 1/102* (2013.01); *E03C 1/104* (2013.01); *E03D 3/00* (2013.01); *Y10T 137/3294* (2015.04)

(58) Field of Classification Search
CPC . E03C 1/102; E03C 1/104; E03D 3/00; Y10T 137/3294
See application file for complete search history.

(56) References Cited

U.S. PATENT DOCUMENTS

| | | | |
|---|---|---|---|
| 2,663,309 | A | 12/1953 | Filliung |
| 2,746,477 | A | 5/1956 | Krause et al. |
| 2,897,835 | A | 8/1959 | Philippe |
| 2,938,532 | A | 5/1960 | Fraser |
| 3,125,114 | A | 3/1964 | Langdon |
| 3,334,646 | A | 8/1967 | Billeter et al. |
| 3,556,137 | A | 1/1971 | Billeter et al. |
| 3,855,639 | A | 12/1974 | Billeter |
| 3,855,640 | A | 12/1974 | Filliung et al. |
| 3,946,108 | A | 3/1976 | Tomlinson et al. |
| 4,777,669 | A | 10/1988 | Rogus |
| 4,913,182 | A | 4/1990 | Whiteside |
| 5,199,115 | A | 4/1993 | Whiteside |
| 5,244,179 | A | 9/1993 | Wilson |
| 5,373,592 | A | 12/1994 | Stoltenberg et al. |
| 5,564,460 | A | 10/1996 | Gronwick et al. |
| 6,019,131 | A | 2/2000 | Hall |
| 6,119,713 | A | 9/2000 | Pino |
| 6,161,814 | A | 12/2000 | Jahrling |
| 6,227,219 | B1 | 5/2001 | Pino |
| 6,349,921 | B1 | 2/2002 | Jahrling |
| 6,934,976 | B2 | 8/2005 | Parsons et al. |
| 6,978,490 | B2 | 12/2005 | Wilson |
| 7,562,399 | B2 | 7/2009 | Parsons et al. |
| 7,802,586 | B1 | 9/2010 | Funari et al. |
| 8,070,128 | B2 | 12/2011 | Snyder et al. |
| 8,201,282 | B2 | 6/2012 | Wilson |
| 8,635,717 | B2 | 1/2014 | Wilson et al. |

*Primary Examiner* — Craig Schneider
*Assistant Examiner* — Kevin Barss
(74) *Attorney, Agent, or Firm* — Quarles & Brady LLP

(57) ABSTRACT

A vacuum breaker having a supporting rib and a skirted section is disclosed. The supporting rib is configured to be axially aligned with air slots in an outlet tube and provide a more robust vacuum breaker sleeve under extreme operating conditions. The skirted section can prevent leakage through air slots during high back pressure operating conditions.

19 Claims, 6 Drawing Sheets

VACUUM BREAKER

CROSS-REFERENCE TO RELATED APPLICATION

This application is based on and claims priority to U.S. Provisional Patent Application No. 62/258,117, filed Nov. 20, 2015, the contents of which are incorporated herein by reference in its entirety for all purposes.

STATEMENT OF FEDERALLY SPONSORED RESEARCH OR DEVELOPMENT

Not applicable.

TECHNICAL FIELD

This invention relates generally to vacuum breakers and, more specifically, to vacuum breakers used in a flush valve assembly.

BACKGROUND

In some water supply systems, contaminated water from plumbing fixtures, such as urinals and toilets, may enter back into the main water supply if a vacuum is drawn on the main supply (e.g., when a fire hose is supplying water from a fire hydrant during a fire). Vacuum breakers are used in these systems to prevent back-siphonage of the contaminated water into the main supply.

Typically, vacuum breakers are installed into an outer tube of a flush valve as described in U.S. Pat. No. 7,802,586 ('586 patent) issued to Zurn Industries, LLC, the entire disclosure of which is hereby incorporated herein by reference. As shown in the '586 patent, the outlet tube of the flush valve includes circumferentially spaced air slots which enable air to flow through the vacuum breaker, as opposed to water, in the event of a vacuum being drawn on the main supply.

Currently, bathroom plumbing equipment (e.g., toilets, urinals, or other plumbing equipment) is moving towards using a lower volume of water per flush at a higher pressure. While this low volume, high pressure strategy may be more efficient, it can introduce a back pressure on the vacuum breaker and test the mechanical durability of the vacuum breaker under the most extreme conditions. The increased back pressure on the vacuum breaker may cause water to leak past the vacuum breaker and out the air slots.

Hence, a need exists for a vacuum breaker that seals during increased back pressure conditions, and provides structural durability at or near the air slots of the outer tube.

SUMMARY

The present invention provides a vacuum breaker having a supporting rib configured to be axially aligned with air slots in an outlet tube and a skirted section which prevents leakage through air slots during high back pressure operating conditions.

In one aspect, a vacuum breaker assembly includes a vacuum breaker sleeve and a flow insert. The vacuum breaker sleeve includes a vacuum sleeve body having a first end and a second end in which the second end has a skirted section extending from the vacuum sleeve body. The vacuum sleeve body also has a first body section with a supporting rib protruding from an inner surface thereof and a second body section in which the second body section includes one or more wall sections circumferentially arranged within the second body section and one or more lip seal sections each having a slit arranged between adjacent wall sections. The vacuum breaker sleeve further includes a sleeve flange extending radially from the vacuum sleeve body on the first end of the vacuum sleeve body which defines a flange recess in which the first body section is arranged between the sleeve flange and the second body section. The flow insert is received within the flange recess and which includes a plurality of flow apertures.

It is contemplated that this vacuum breaker assembly can be received in an outlet tube having a plurality of circumferentially arranged air slots, such that the supporting rib on the vacuum breaker sleeve is axially aligned with the air slots on the tube.

According to another aspect, a vacuum breaker assembly is configured to be installed in an outlet tube having a plurality of circumferentially arranged air slots. This vacuum breaker assembly includes a vacuum breaker sleeve and a flow insert. The vacuum breaker sleeve includes a vacuum sleeve body having a first end and a second end that has a skirted section extending from the vacuum sleeve body. The vacuum breaker sleeve also includes a sleeve flange that extends radially from the vacuum sleeve body on the first end of the vacuum sleeve body and defines a flange recess. The flow insert is received within this flange recess and includes a plurality of flow apertures. A supporting rib protrudes from an inner surface of the vacuum sleeve body and is axially aligned with the air slots.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow.

Figure 1:
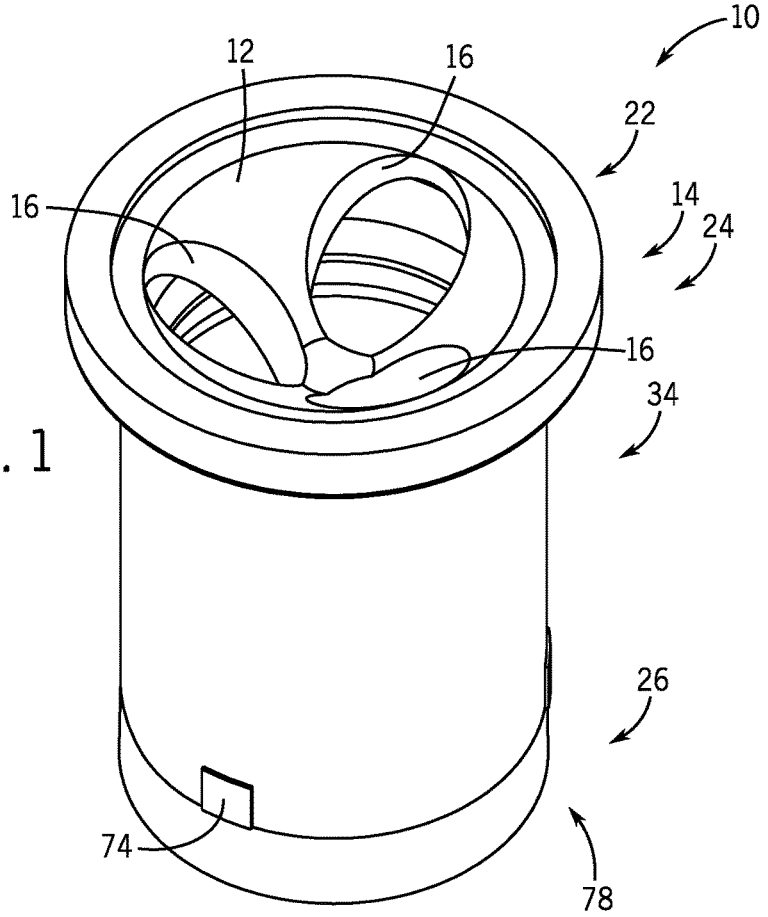
FIG. 1 shows a perspective view of a vacuum breaker assembly according to one embodiment of the present invention.
Figure 2:
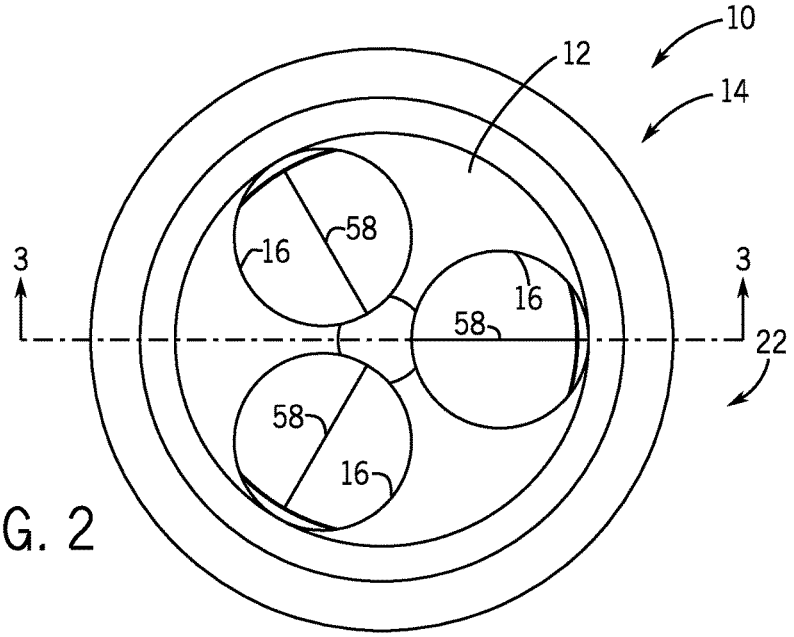
FIG. 2 shows a top view of the vacuum breaker assembly of FIG. 1.

FIG. 1 shows a vacuum breaker assembly 10 according to one embodiment of the present invention. As shown in FIGS. 1 and 2, the vacuum breaker assembly 10 includes a flow insert 12 received by a vacuum breaker sleeve 14. The flow insert 12 includes a plurality of flow apertures 16 to enable fluid to flow into the vacuum breaker sleeve 14. In the illustrated embodiment, the flow insert 12 includes three flow apertures 16 circumferentially arranged in approximately 120 degree increments. It should be known that the quantity and arrangement of the flow apertures 16 is not meant to be limiting in any way and, in other embodiments, the flow insert 12 may include any number of flow apertures 16 arranged in any way, as desired. In some forms, the flow insert 12 is fabricated from a plastic material. In one form, the flow insert 12 can be fabricated from nylon. In some forms, the vacuum breaker sleeve 14 is fabricated from a flexible elastomeric material. In one particular form, the vacuum breaker sleeve 14 is fabricated from silicon.

Figure 3:
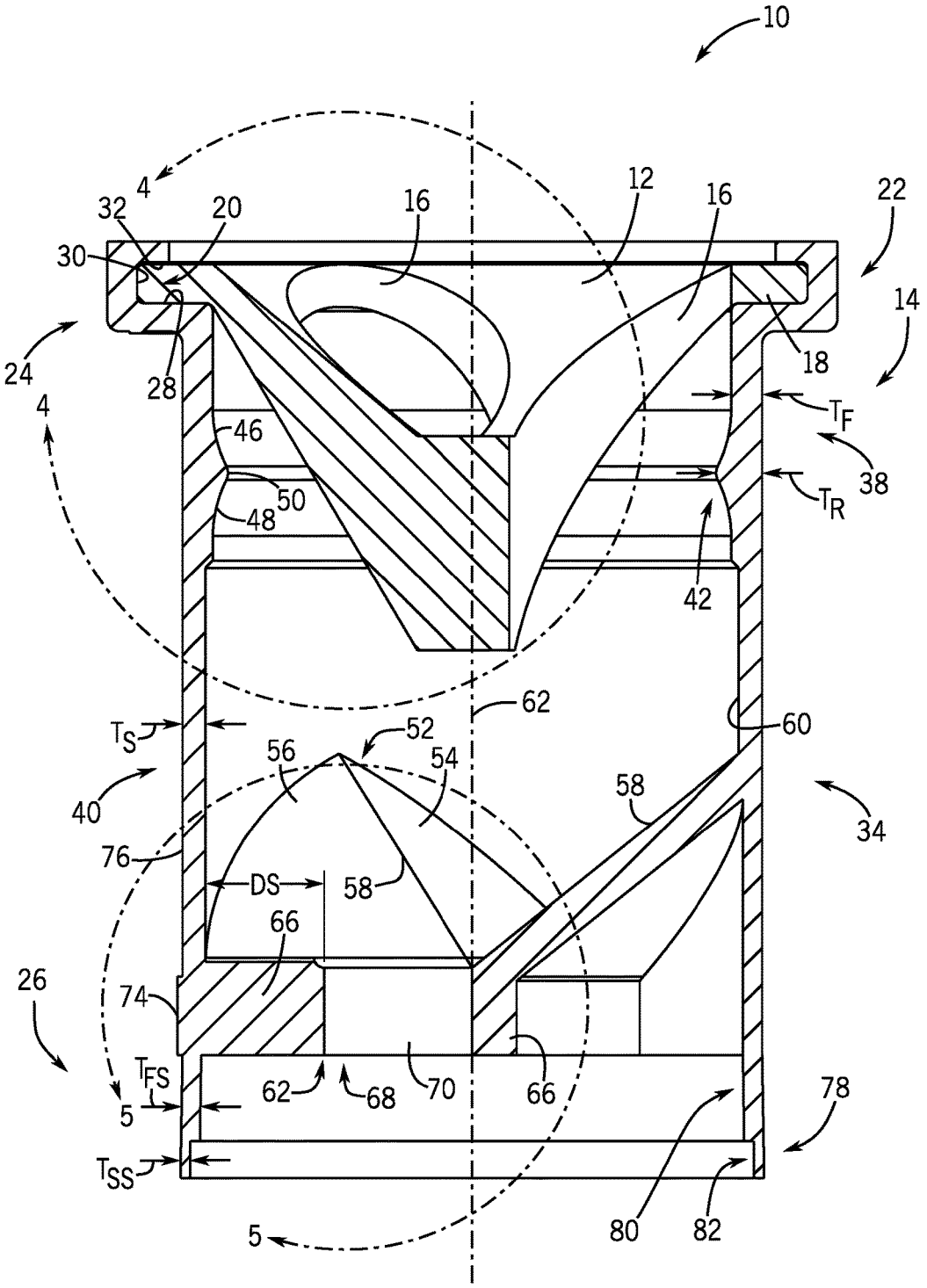
FIG. 3 shows a cross-sectional view of the vacuum breaker assembly taken along line 3-3 in FIG. 2.

With further reference being made to FIG. 3, the flow insert 12 defines a substantially frustoconical shape, and includes an insert flange 18 received within a sleeve recess 20 defined by a sleeve flange 22 of the vacuum breaker sleeve 14. In other embodiments, the flow insert 12 can define a substantially flat shape and may not include a flange.

The vacuum breaker sleeve 14 includes a first end 24 and a second end 26 arranged downstream of the first end 24. The first end 24 of the vacuum breaker sleeve 14 includes the sleeve flange 22. The sleeve flange 22 includes a first sleeve flange surface 28, a second sleeve flange surface 30 extending substantially perpendicularly from the first sleeve flange surface 28, and a third sleeve flange surface 32 extending substantially perpendicularly from the second sleeve flange surface 30. The first, second, and third sleeve flange surfaces 28, 30, and 32 combine to define the sleeve recess 20 which receives the insert flange 18 of the flow insert 12.

A vacuum sleeve body 34 extends from the sleeve flange 22 and is arranged between the first end 24 and the second end 26 of the vacuum breaker sleeve 14. The vacuum sleeve body 34 defines a substantially cylindrical shape. In other forms, the vacuum sleeve body 34 may define other shapes, as desired. The vacuum sleeve body 34 includes a first body section 38 arranged between the sleeve flange 20 and a second body section 40. The first body section 38 defines a first body section thickness $T_F$ and the second body section 40 defines a second body section thickness $T_S$. In most embodiments, the first body section thickness $T_F$ is greater than the second body section thickness $T_S$.

Figure 4:
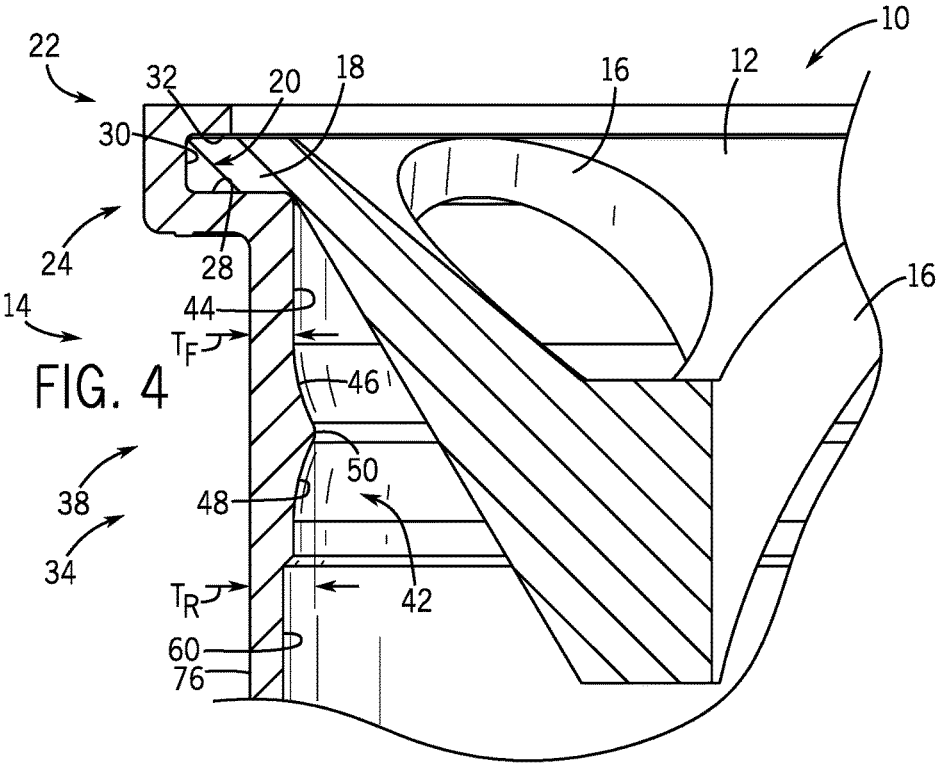
FIG. 4 shows a magnified view of section 4-4 of the vacuum breaker assembly of FIG. 3.

With reference to FIGS. 3 and 4, the first body section 38 includes a supporting rib 42 extending from an inner surface 44 of the first body section 38. The supporting rib 42 includes a first arcuate surface 46 and a second opposing arcuate surface 48. The first arcuate surface 46 and the second arcuate surface 48 each arc away from (i.e., protrude) the inner surface 44 towards a rib peak 50. As shown in FIG. 4, the first arcuate surface 46 and the second arcuate surface 48 each define a substantially concave shape. However, in other forms, the supporting rib 42 may define an alternative shape that protrudes from the inner surface 44. For example, the supporting rib 42 can include two substantially linear surfaces that meet at the rib peak 50, or the supporting rib 42 may define a substantially round (i.e., semi-circular or elliptical) shape.

The rib peak 50 defines a rib thickness $T_R$ which is greater than the first body section thickness $T_F$. A rib thickness ratio $R_T$ is defined as the ratio between the rib thickness $T_R$ and the first body section thickness $T_F$. In some forms, the rib thickness ratio $R_T$ can be greater than approximately 1. In other forms, the rib thickness ratio $R_T$ can be greater than approximately 1.4. In still other embodiments, the rib thickness ratio can be greater than approximately 1.6. In yet other embodiments, the rib thickness ratio $R_T$ can be between approximately 1.3 and approximately 1.7.

Figure 5:
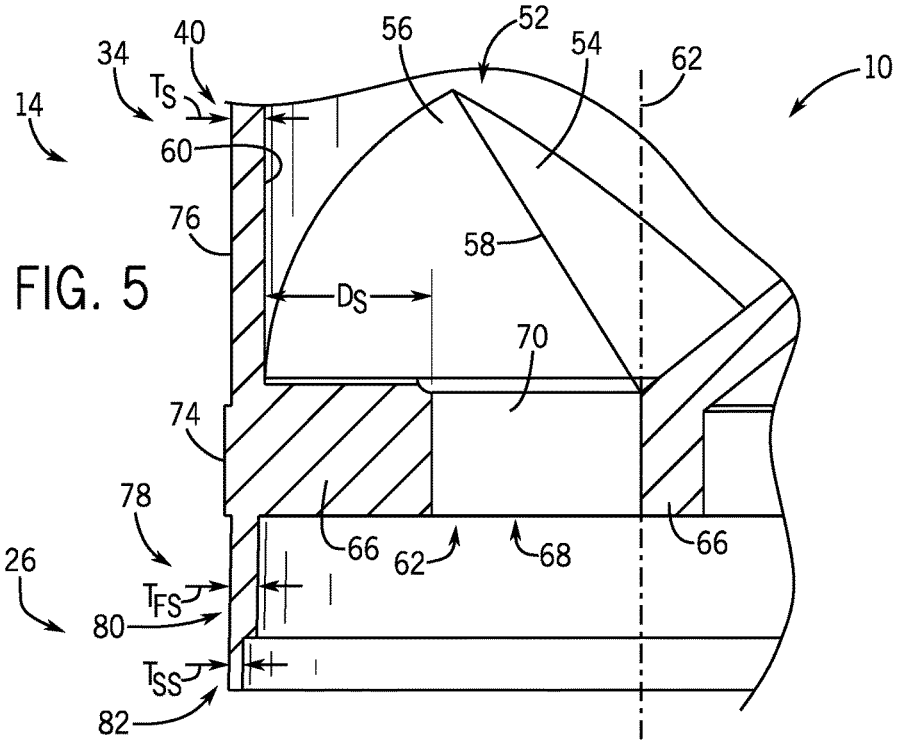
FIG. 5 shows a magnified view of section 5-5 of the vacuum breaker assembly of FIG. 3.
Figure 6:
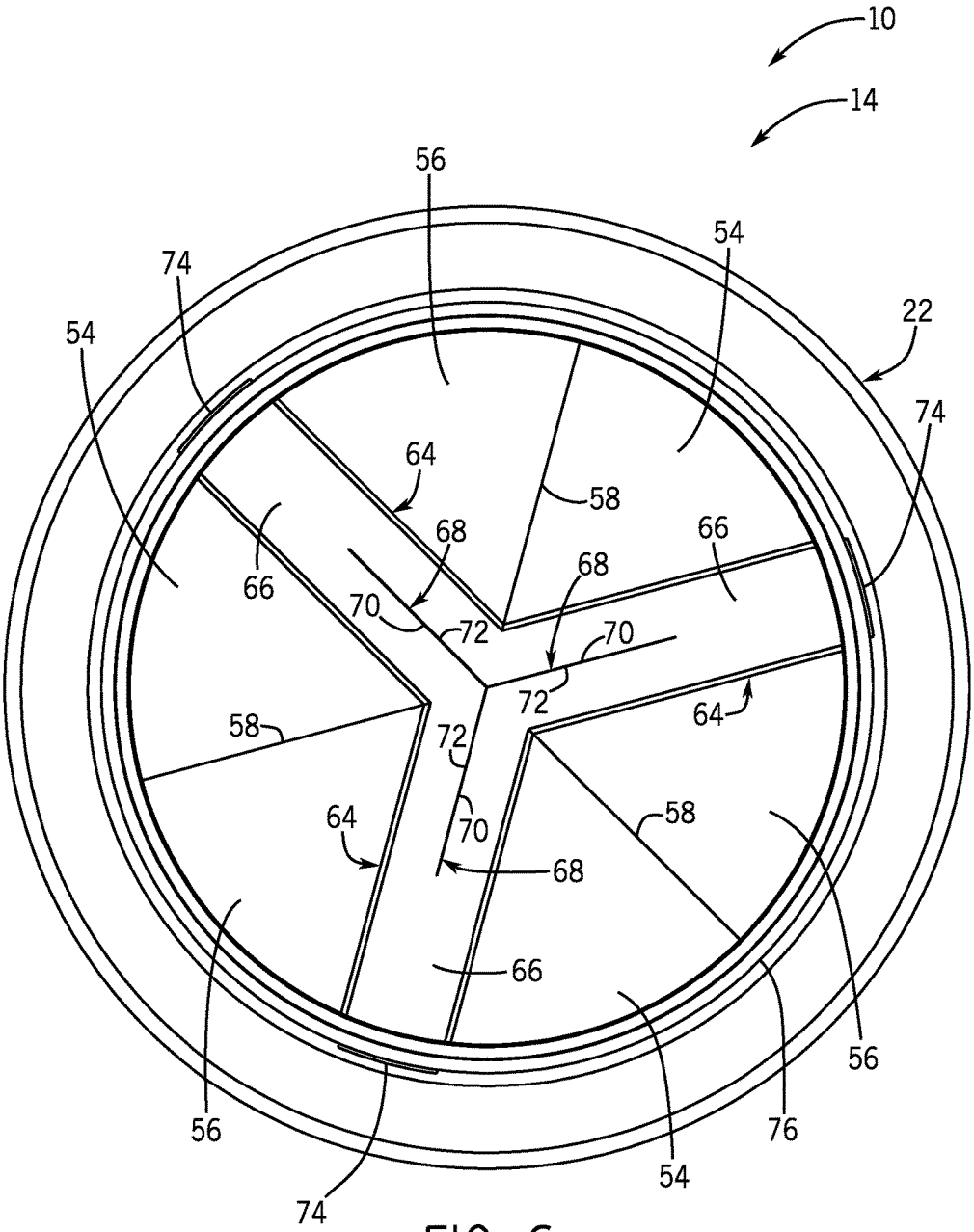
FIG. 6 shows a bottom view of the vacuum breaker assembly of FIG. 1.

With reference to FIGS. 3, 5, 6, a plurality of wall sections 52 are arranged within the second body section 40. The wall sections 52 each include a first angled wall 54, a second angled wall 56, and an intersection line 58 where the first angled wall 54 meets the second angled wall 56. The intersection line 58 slopes downstream from an inner surface 60 of the second body section 40 towards a center axis 62 of the vacuum breaker sleeve 14. The first angle wall 54 and the second angle wall 56 slope in opposing directions from the intersection line 58 towards one of a plurality of lip seal sections 64. The illustrated vacuum breaker sleeve 14 includes three wall sections 52 circumferentially arranged in approximately 120 degree increments. However, in other forms, the vacuum breaker sleeve 14 may include more or less than three wall sections 52 arranged in any increments, as desired.

The lip seal sections 64 each include a rib 66 having a slit 68 formed therein. Each of the ribs 66 are integrally formed with and extend from the first angled wall 54 of one of the wall sections 52 and the second angled wall 56 of another circumferentially adjacent wall section 52. Each slit 68 extends radially from the center axis 62 of the vacuum breaker sleeve 14 to a location between the inner surface 60 of the second body section 40 and the center axis 62. Specifically, a distance $D_s$ is defined between an end 69 of the slits 68 and the inner surface 60 of the second body member 40.

In some forms, each slit 68 may extend from the center axis 60 to the inner surface 60 of the second body section 40. Each slit 68 includes a first slit wall 70 and an opposing second slit wall 72. The first slit wall 70 and the second slit wall 72 of the slit 68 are configured to split apart to permit a flow of fluid through the vacuum breaker sleeve 14. The illustrated vacuum breaker sleeve 14 includes three lip seal sections 64 circumferentially arranged in approximately 120 degree increments. In other embodiments, the vacuum breaker sleeve 14 can include more or less than three lip seal sections 64.

A plurality of rib protrusions 74 protrude from an outer surface 76 of the vacuum sleeve body 34. The rib protrusions 74 protrude from the outer surface 76 at a location that is substantially axially aligned with the ribs 66. In the illustrated form, the rib protrusions 74 define a generally rectangular shape. In other forms, however, the rib protrusions may define a circular, elliptical, or other shape. With specific reference to FIG. 6, the illustrated vacuum breaker sleeve 14 includes three rib protrusions 74 which are arranged around the outer surface 76 of the vacuum sleeve body 34 in similar circumferential increments as the ribs 66.

With continued specific reference to FIGS. 3, 5, and 6, the second end 26 of the vacuum breaker sleeve 14 includes a skirted section 78 extending from the vacuum breaker body 34 adjacent to the rib protrusions 74. The skirted section 78 is a generally continuous extension of the vacuum breaker body 34. Accordingly, the skirted section defines a substantially cylindrical shape. As illustrated, the skirted section 78 includes a first skirted portion 80 arranged between the ribs 66 and a second skirted portion 82. The first skirted portion 80 defines a first skirted thickness $T_{FS}$ and the second skirted portion defines a second skirted thickness $T_{SS}$. In some forms, the first skirted thickness $T_{FS}$ is generally less than the second body section thickness $T_S$. With specific reference to FIG. 5, the skirted section 78 defines a step change decrease in thickness from the first skirted thickness $T_{FS}$ to the second skirted thickness $T_{SS}$.

Figure 7:
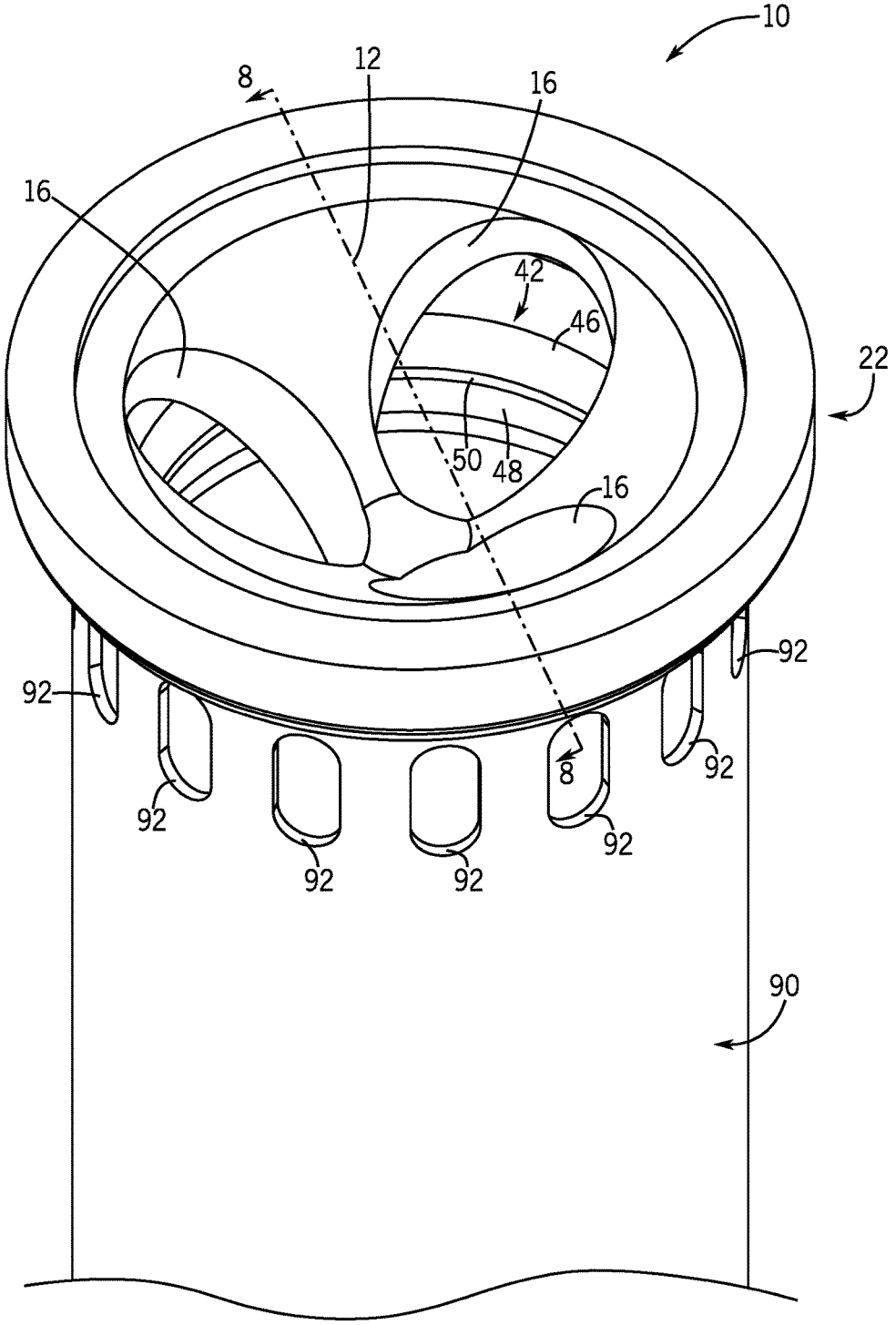
FIG. 7 shows a perspective view of the vacuum breaker assembly of FIG. 1 installed in an outlet tube.
Figure 8:
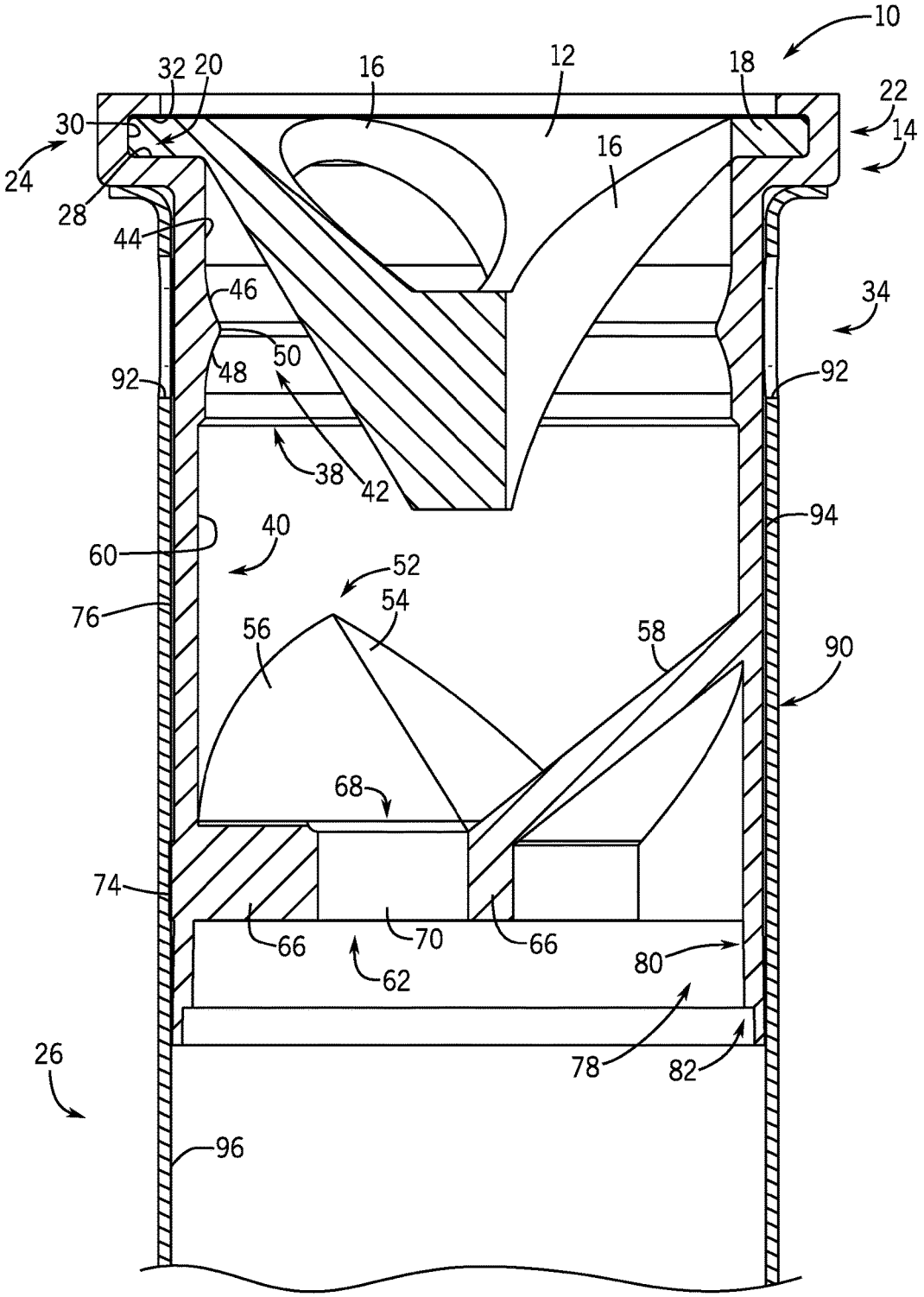
FIG. 8 shows a cross-sectional view of the vacuum breaker assembly installed into the outlet tube taken along line 8-8 in FIG. 7.

One non-limiting example of the operation of the vacuum breaker assembly 10 will be described with reference to FIGS. 7 and 8. In operation, the vacuum breaker 10 is configured to be axially installed in an outlet tube 90 of a flush valve. The outlet tube 90 includes a plurality of air slots 92 circumferentially arranged around the outlet tube 90. As best shown in FIG. 8, with the vacuum breaker body 20 received within the outlet tube 90, an air gap 94 exists between the outer surface 76 of the vacuum sleeve body 34 and an inner surface 96 of the outlet tube 90.

Typically, the outlet tube 90 is connected to an inlet of a urinal or toilet and the first end 24 of the vacuum breaker sleeve 14 is in fluid communication with a main water supply for the toilet or urinal. As is known in the art, flush valves typically include a flushing mechanism which controls when fluid from the main supply is provided to the inlet of the toilet or urinal (i.e., a flush). Once fluid from the main supply is provided to the vacuum breaker assembly 10, fluid enters the vacuum breaker sleeve 14 through the flow apertures 16 in the flow insert 12. Fluid then flows through the vacuum breaker body 20 until it reaches the lip seal sections 64. Fluid pressure on the lip seal sections 64 forces the first slit walls 70 and the second slit walls 72 of the slits 68 to temporarily and reversibly split apart and permit fluid out of the vacuum breaker sleeve 14 and to the inlet of the toilet or urinal.

When fluid is within the vacuum breaker body 20, hydrostatic pressure can force the first body section 38 radially outward against the air slots 92 of the outlet tube 90. As shown in FIG. 8, the supporting rib 42 is axially aligned with the air slots 92. The supporting rib 42 provides structural support for the vacuum sleeve body 20 at the axial location of the air slots 92 which can prevent wear and fatigue of the vacuum breaker body 20 due to hydrostatic pressures locally against the air slots 92. Additionally, the supporting rib 42 selectively supports the vacuum sleeve body 20. That is, the supporting rib 42 negates the need for the entire first body section 38 to have an increased thickness. But by having some thinner sections, this first body section 38 is still sufficiently flexible in a radially outward direction.

During some operating conditions, such as after a flush, a high back pressure can act on the vacuum breaker assembly 10. In the event of a high back pressure, the skirted section 78 of the vacuum breaker sleeve 14 deflects outwardly (i.e., towards the inner surface 96 of the outlet tube 90) and engages the inner surface 96 of the outlet tube 90. This engagement provides a seal between the vacuum breaker sleeve 14 and the outlet tube 90 such that fluid cannot flow into the air gap 94 and leak out of the air slots 92.

During other operating conditions, a vacuum may be drawn on the main supply. In the event of a vacuum being drawn by the main supply, ambient air is drawn through the air slots 92 and into the air gap 94. This causes vacuum sleeve body 20 to collapse inward (i.e., away from the inner surface 96 of the outlet tube 90), which inhibits fluid to flow from the inlet of the toilet or urinal back through the vacuum breaker assembly 10 and into the main supply.

Thus, the vacuum breaker assembly 10 structurally resists wear due to hydrostatic pressures, prevents leakage through the air slots 92 in the event of high back pressure, and prevents fluid flow back into the main supply in the event of a vacuum being drawn by the main supply.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A vacuum breaker assembly comprising:

a vacuum breaker sleeve including:

a vacuum sleeve body having a first end and a second end, the second end having a skirted section extending from the vacuum sleeve body, the vacuum sleeve body having a first body section and a second body section, the second body section including one or more wall sections circumferentially arranged within the second body section and one or more lip seal sections each having a slit arranged between adjacent wall sections;

a sleeve flange extending radially from the vacuum sleeve body on the first end of the vacuum sleeve body and defining a flange recess in which the first body section is arranged between the sleeve flange and the second body section; and a supporting rib protruding from an inner surface of the first body section wherein the supporting rib includes a first arcuate surface, a second arcuate surface, and a rib peak;

a flow insert received within the flange recess and including a plurality of flow aperture.

2. The vacuum breaker assembly of claim 1, wherein the first arcuate surface and the second arcuate surface define a substantially concave shape.

3. The vacuum breaker assembly of claim 1, wherein a rib thickness ratio of a rib thickness of the supporting rib to a wall thickness of the first body section is greater than 1.4.

4. The vacuum breaker assembly of claim 1, wherein a rib thickness ratio of a rib thickness of the supporting rib to a wall thickness of the first body section is greater than 1.6.

5. The vacuum breaker assembly of claim 1, wherein a rib thickness ratio of a rib thickness of the supporting rib to a wall thickness of the first body section is between 1.3 and 1.7.

6. The vacuum breaker assembly of claim 1, wherein the first body section defines a first body thickness which is greater than a second body thickness defined by the second body section.

7. A vacuum breaker assembly comprising:

a vacuum breaker sleeve including:

a vacuum sleeve body having a first end and a second end, the second end having a skirted section extending from the vacuum sleeve body, the vacuum sleeve body having a first body section and a second body section, the second body section including one or more wall sections circumferentially arranged within the second body section and one or more lip seal sections each having a slit arranged between adjacent wall sections, wherein the skirted section includes a first skirted portion arranged between the lip seal sections and a second skirted portion;

a sleeve flange extending radially from the vacuum sleeve body on the first end of the vacuum sleeve body and defining a flange recess in which the first body section is arranged between the sleeve flange and the second body section; and a supporting rib protruding from an inner surface of the first body section;

a flow insert received within the flange recess and including a plurality of flow apertures.

8. The vacuum breaker assembly of claim 7, wherein the first skirted portion defines a first skirted thickness which is greater than a second skirted thickness defined by the second skirted portion.

9. The vacuum breaker assembly of claim 8, wherein the skirted section defines a step change in thickness from the first skirted thickness to the second skirted thickness.

10. A vacuum breaker assembly configured to be installed in an outlet tube having a plurality of circumferentially arranged air slots, the vacuum breaker assembly comprising:

a vacuum breaker sleeve including:

a vacuum sleeve body having a first end and a second end, the second end having a skirted section extending from the vacuum sleeve body;

a sleeve flange extending radially from the vacuum sleeve body on the first end of the vacuum sleeve body and defining a flange recess; and a supporting rib protruding from an inner surface of the vacuum sleeve body and axially aligned with the air slots;

a flow insert received within the flange recess and including a plurality of flow apertures.

11. The vacuum breaker assembly of claim 10, wherein the vacuum sleeve body includes one or more wall sections circumferentially arranged within the vacuum sleeve body and one or more lip seal sections each having a slit arranged between adjacent wall sections.

12. The vacuum breaker assembly of claim 10, wherein the supporting rib includes a first arcuate surface, a second arcuate surface, and a rib peak.

13. The vacuum breaker assembly of claim 12, wherein the first arcuate surface and the second arcuate surface define a substantially concave shape.

14. The vacuum breaker assembly of claim 12, wherein a rib thickness ratio of a rib thickness of the supporting rib to an adjacent wall thickness is greater than 1.4.

15. The vacuum breaker assembly of claim 12, wherein a rib thickness ratio of a rib thickness of the supporting rib to an adjacent wall thickness is greater than 1.6.

16. The vacuum breaker assembly of claim 12, wherein a rib thickness ratio of a rib thickness of the supporting rib to an adjacent wall thickness is between 1.3 and 1.7.

17. The vacuum breaker assembly of claim 10, wherein the skirted section includes a first skirted portion arranged between the lip seal sections and a second skirted portion.

18. The vacuum breaker assembly of claim 17, wherein the first skirted portion defines a first skirted thickness which is greater than a second skirted thickness defined by the second skirted portion.

19. The vacuum breaker assembly of claim 18, wherein the skirted section defines a step change in thickness from the first skirted thickness to the second skirted thickness.

* * * * *